United States Patent [19]

Kippenberg et al.

[11] Patent Number: 4,749,830

[45] Date of Patent: Jun. 7, 1988

[54] CONTACT PIECES FOR VACUUM SWITCHGEAR, AND METHOD FOR THE MANUFACTURE THEREOF

[75] Inventors: Horst Kippenberg, Herzogenaurach; Reiner Müller, Kleinsendelbach; Hannelore Schnödt, Hemhofen; Irmo Paulus, Möhrendorf; Rüdiger Hess, Berlin, all of Fed. Rep. of Germany

[73] Assignee: Siemens Aktiengesellschaft, Munich, Fed. Rep. of Germany

[21] Appl. No.: 8,799

[22] Filed: Jan. 30, 1987

[30] Foreign Application Priority Data

Jan. 30, 1986 [DE] Fed. Rep. of Germany ..... 3602835

[51] Int. Cl.[4] ..... H01H 33/66

[52] U.S. Cl. ..... 200/144 B

[58] Field of Search ..... 200/144 B

[56] References Cited

U.S. PATENT DOCUMENTS

| | | | |
|---|---|---|---|
| 2,975,255 | 3/1961 | Lafferty | 200/144 B |
| 3,596,027 | 7/1971 | Okutomi et al. | 200/144 B |

FOREIGN PATENT DOCUMENTS

| | | | |
|---|---|---|---|
| 0083200 | 7/1983 | European Pat. Off. . | |
| 0083245 | 7/1983 | European Pat. Off. . | |
| 0090579 | 10/1983 | European Pat. Off. | 200/144 B |
| 0172411 | 2/1986 | European Pat. Off. . | |
| 0175349 | 3/1986 | European Pat. Off. | 200/144 B |
| 1081950 | 5/1960 | Fed. Rep. of Germany | 200/144 B |
| 1236630 | 3/1967 | Fed. Rep. of Germany | 200/144 B |
| 2124707 | 2/1973 | Fed. Rep. of Germany | 200/144 B |
| 3150846 | 3/1983 | Fed. Rep. of Germany | 200/144 B |
| 515599 | 12/1971 | Switzerland | 200/144 B |
| 2105910 | 3/1983 | United Kingdom | 200/144 B |
| 2106141 | 4/1983 | United Kingdom . | |

OTHER PUBLICATIONS

*Elektrotechnik* "Schalten von Hochspannungsmotoren," 66/22, Nov. 1984, pp. 16–23, by K. Stegmuller.

*Primary Examiner*—Robert S. Macon

*Attorney, Agent, or Firm*—Kenyon & Kenyon

[57] ABSTRACT

Contact pieces for vacuum switchgear comprise a base material with additives of readily vaporizable components to produce a sufficiently conductive switch path in the switch-off process. It is desired to have an overvoltage-free switching behavior for the vacuum switchgear. The additives are concentrated in a firmly adhering layer covering the switching surface of the contact piece. Such contact pieces can be manufactured in particular by direct fusing of the additives on the surface, by fusing a separate application of the additives in powder form, in granulate form or as foil or sheet on the surface or alternatively by vapor deposition of the additives on the switching surface of a given contact piece body of base material. Advantageously, a CuCr contact piece base material is used.

26 Claims, 1 Drawing Sheet

CONTACT PIECES FOR VACUUM SWITCHGEAR, AND METHOD FOR THE MANUFACTURE THEREOF

FIELD OF THE INVENTION

This invention relates to contact pieces for a vacuum switchgear comprised of a base material with additives of readily vaporizable components to produce a sufficiently conductive switching path in the switch-off process. This invention also relates to methods for the manufacture of such contact pieces.

BACKGROUND OF THE INVENTION

In inductive circuits, when vacuum switches are used in specific cases, e.g. in turning off a starting motor, multiple re-ignitions may occur with virtual current ruptures, which lead to a strong voltage load in the incoming turns of the switched equipment and which may possibly require protective measures. See, e.g., K. Stegmuller, *Elektrotechnik* 66/22, Nov. 1984, pp. 16–23. Therefore, there is a need for an overvoltage-free vacuum switchgear which does not have this tendency of voltage increases when switching small currents in inductive circuits. This means there is the requirement for the contact material in such switches to have a long arc burning to the range of zero current, i.e., after a low rupture current of approximately less than 0.2 A, and at the same time after a sufficiently conductive arc, so as to reduce the instability of the rupture process to a minimum. To fulfill this requirement, charge carriers must be generated in sufficient number by the arc during switching, i.e., a high rate of vapor generation from the cathode must exist.

The switch-off capacity of the system is imperiled by the intensive delivery of metal vapor and hence by a large quantity of charge carrier. Therefore, a contact material is required which shows an overvoltage-free switching behavior as well as a high power switching capacity.

To obtain contact materials with an overvoltage-free switching behavior, it has been previously proposed to add to a base material, e.g. CuCr, a sufficient quantity of readily vaporizable additive components. Such materials are described, for example, in EP-A No. 00 83 200, EP-A No. 00 83 245, U.S. Pat. No. 4,424,429 and EP-A No. 00 90 579.

The additives discussed in these references are already known for use in vacuum switch contact materials for other purposes, for example, for rupture current reduction or welding force reduction, and are distributed largely homogeneously in the volume of the contact material by various methods, so as to be always replenishable in case of burnoff losses.

These known practices have serious disadvantages.

Since with an increasing magnitude of the switch-off current the amount of vaporized contact material and hence of charge carriers increases greatly due to the presence of the readily vaporizable additives, the switch-off capacity is impaired considerably with increasing currents and is clearly reduced in comparison with materials without additives.

Due to the high percentage of, as a rule, brittle additive materials or brittle phases of these materials, the material loses its necessary ductility, which is important for the mechanical load during the switching process and for good electrical contact-making under permanent current load.

At the same time, due to the poorly conducting additive materials, the current and heat conduction of the electrodes is reduced, i.e., problems resulting from increased evolution of heat may occur.

Such contact material combinations are preferably produced by powder metallurgical techniques. Because of the production technique and in consideration of the additives used, e.g., as with the material disclosed in U.S. Pat. No. 4,424,429, a considerable susceptibility to structure defects, inhomogeneities and high contents of residual gases results which bring about an additional limitation in switching efficiency and in voltage strength.

A major obstacle in terms of fabrication by the use of the mentioned type of the so-called "low surge" contact materials results from the fact that most of the cited additives also have good anti-welding properties. Materials highly alloyed with these additives may create considerable problems with respect to their bonding technology.

OBJECTS OF THE INVENTION

It is therefore an object of the present invention to provide contact pieces of the initially mentioned type which exhibit a sufficient overvoltage-free switching behavior combined with good power switching capacity and which present no problems with respect to bonding with copper contact piece substrates.

These and other objects of the present invention will become apparent from the description and claims in conjunction with the drawings.

SUMMARY OF THE INVENTION

To avoid the disadvantages of the prior art, the present invention is directed to providing a time-tested base material, e.g., CuCr, with a layer of suitable, readily vaporizable additives or highly concentrated compounds/alloys of these additives only on the switching surface of the contact piece base material while leaving the base material itself unalloyed. A suitable CuCr base material would have a volume percentage of about 30% to 60% Cr. It has been confirmed by tests that this arrangement suffices for obtaining good results with respect to a largely overvoltage-free switching behavior. Surprisingly, a rapid decrease in the effect of the readily vaporizable additives does not take place as was to be feared on the basis of the inevitable depletion effects and the contact erosion brought about thereby. Although not intended to limit the invention, this may be explained by the assumption that upon vaporization of the additives, a major portion thereof re-condenses on the switching surfaces in the region of the contact gap.

An essential advantage of the present invention resides in that the present invention achieves both the desired overvoltage-free switching behavior and a satisfactory power switching capacity. Both advantages are believed based on the fact that at small and medium switching currents, for which overvoltage-free switching behavior is stipulated, the applied layer of readily vaporizable additives becomes effective, and that at high currents, for which safe or reliable switching-off is stipulated, the high-energy switching arc penetrates to the base material and there does not liberate any additional readily vaporizable additives which would unduly hinder the quenching process.

Another advantage in accordance with the present invention is that a high-grade and ductile base material can be employed. In addition, through the use of a time-tested base material, the known vacuum hard-soldering (brazing) methods for bonding with the contact support or contact pin can still be used, i.e., there are no problems with the bonding technique.

Embodiments of the invention with respect to material selection of the additives will be described specifically. The adhering layers of these additives can be produced by different process technologies which will hereinafter be discussed in conjunction with the figures of the drawings.

A layer of selected additives is adhered on a foundation of suitable contact material, for example of CuCr melt material.

Depending on the requirements and on the chosen layer material, the layer thickness is suitably less than 2 mm, more suitably less than 1 mm, and is preferably between about several 1/100 mm to about several 1/10 mm. However, layers of greater thickness (several mm) may also be used if for process-technological reasons the layer is mixed with components of the base material.

As components for the layer, i.e. as suitable additives, there enter into consideration in particular intermetallic compounds of the elements Se, Te, Pb, Bi with one another or with Ag, Al, Ba, Ca, Ce, In, La, Li, Sb, Sn, Sr, Ti or Zr or respectively with Cu as base material. Also Mg or Sm are possible for the formation of such phases. All elements have heretofore been known as additive components specifically for such property improvements as require an increase of the metal vapor density under arc load, e.g. for obtaining a low rupture current. Concerning this, reference is made for example to U.S. Pat. Nos. 2,975,255, 3,596,027 and 4,014,688/9.

For process technological reasons, the melting or softening temperature of the layer is to be selected higher than the soldering temperature used (e.g. T 800° C.). Examples of layer components with an appropriate melting point are: $Ag_2Se$, $Ag_2Te$, $Al_2Se_3$, $Al_2Te_3$, $Ba_2Bi_3$, $Ba_2Pb$, $Bi_2Ca_3$, $Bi_3Ce_4$, $Bi_3La_4$, $BiLi_3$, $Bi_2Mg_3$, $Bi_2Zr_3$, $Ca_2Pb$, $Ce_2Pb$, $Cu_2Se$, $Cu_2Te$, $In_2Se_3$, LaPb or $La_2Pb$, $Li_2Se$, $Li_2Te$, PbSe, $Pb_2Sm$, PbTe, $PbTi_2$, $Pb_3Zr_5$, SeSn, SeZn, TeTi, TeZn.

Important for the suitability of the layer as intended is its good adhesion on the base material. This is achieved alternatively by fusing on, through a melt reaction, or through sintering on in the liquid phase. To facilitate the alloying-on of the layer, additives can be also used which react with the base material or with a component thereof and thus produce such a layer which is stable at the soldering temperature. Such additives are e.g. InSe, $In_2Te_3$, $Sb_2Se_3$ or $Sb_2Te_3$, which form, for example with Cu of a CuCr base material, suitable three-component systems. The layer must by no means contain any loosely bound particles, as voltage strength and switching behavior would then be impaired.

Because material is exchanged between the electrodes through the switching processes, it may be sufficient to coat only one of the contact pieces of the vacuum switch in order to obtain a sufficient reduction of the over- voltages.

DETAILED DESCRIPTION

Figure 1:
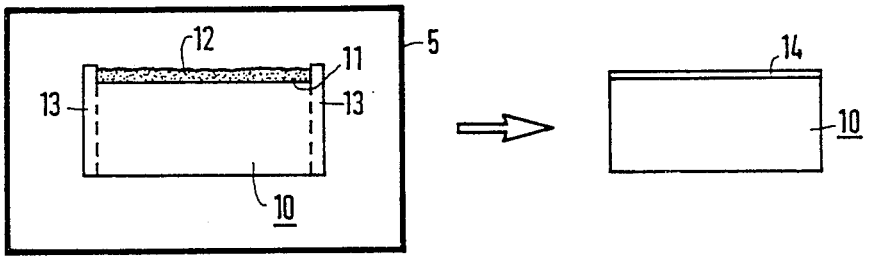
FIGS. 1 to 3 illustrate three different examples of manufacturing processes of contact pieces in accordance with the present invention.

In FIG. 1, a surface 11 of a shaped body 10 of a CuCr base material, e.g. CuCr50, is covered with particles 12 of $Ag_2Se$ powder. The quantity of powder is selected so that after the end of the process there results a layer thickness of about 50 to 100 μm. A protective mantle or respectively a raised edge 13 of body 10 prevents the powder from sliding down on the side of the shaped body 10 or from flowing down during the melting process. The shaped body 10 is heated with the powder 12 in a vessel 5 under vacuum (e.g., p less than $10^{-3}$ mbar) or in a dilute high-purity inert gas atmosphere to about 950° C. and left at this temperature for a period of, e.g., about 10–20 min. The $Ag_2Se$ powder then melts, bonds to the CuCr substrate of body 10, and forms the desired layer 14. After cooling, the edge 13 of the shaped body 10 is machined down. The layer 14 can be employed as the contact surface of the contact piece and is thus produced directly, i.e., without remachining.

Figure 2:
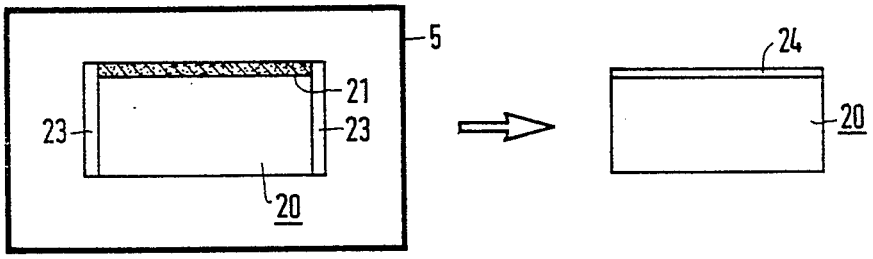

In FIG. 2, a powder mixture of 20 to 25% Cr, 30–40% $Sb_2Te_3$, balance Cu is pressed to form a flat disk 22 about 1–3 mm thickness, which is placed as an application on the surface 21 of a foundation 20 of CuCr, e.g. CuCr50, having protective jacket 23. The arrangement is heated to about 1000° C. in a vessel 5 containing a vacuum or inert gas atmosphere as described in conjunction with the embodiment of FIG. 1 and left at this temperature for 30 to 60 minutes. Liquid-phase sintering of the applied pressed disk 22 then takes place, and the $Sb_2Te_3$ melting at the about 622° C. is transformed preferably into $Cu_2Te$. Via the Sb then dissolved in Cu, there results a faultless (defect-free) bonding to the surface 21 of the foundation 20 of CuCr. Subsequently, the application 22 can be machined by clipping to provide a layer 24 having the desired thickness.

Figure 3:
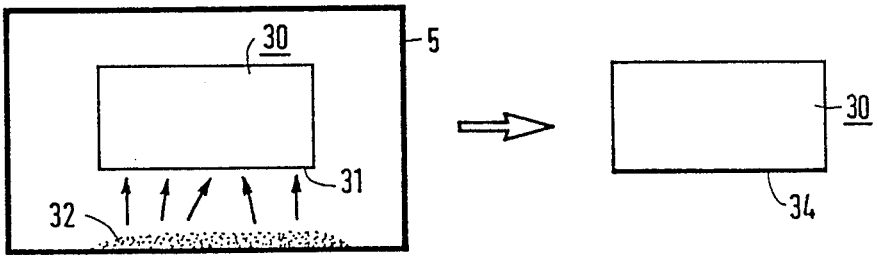

In FIG. 3, a contact piece 30 of CuCr, e.g. of CuCr 50, is provided with a layer 34 of PbSe about 50 μm thick. In this example, the layer 34 of the additives 32 is produced by known vapor deposition techniques on the underside 31 of the contact piece 30 in the vacuum vessel 5 for example by cathode sputtering or ion plating. The layer 34 can serve as the switching surface without remachining.

For the contact pieces according to the embodiment of FIG. 2, the proportion of the additives relative to the base material can be varied in suitable manner and may be for example 30% (i.e., about ⅓), while in FIG. 1 and FIG. 3 a pure additive cover layers exist. In each case there is used for the additives at least one of such elements whose vapor pressure at 1000° C. is above approximately 1 mbar and which form intermetallic phases with one another or with other metals. The vapor pressure of these phases is then of different orders of magnitude than the vapor pressure of the individual components. By action of the arc in switching, however, the intermetallic phase is dissociated into the components with corresponding vapor pressure. During the soldering process, however, the formed intermetallic phases are not yet dissociated, so that only the vapor pressure of these phases is determining. Owing to this, no impairments due to excessive metal vapor evolution occur in the soldering process.

Table 1 lists some examples for rupture currents as measured on contact pieces according to the invention, i.e. on CrCu contact bodies with a layer provided as described in Table 1.

TABLE 1

| Contact layer composition | Rupture currents (in A at 40 A) | |
|---|---|---|
| | Average | Maximum |
| $Ag_2Te$ | 0.05 | 0.35 |
| $Ag_2Se$ | 0.05 | 0.45 |
| $Sb_2Te_3$ | 0.07 | 0.40 |
| $Sb_2Se_3$ | 0.07 | 0.50 |
| $CuCr22Sb_2Te_330$ | 0.20 | 0.70 |
| CuCr22PbSe30 | 0.10 | 0.50 |

Specifically with contact pieces produced according to FIG. 2, three-pole switching tests were carried out. It was found that it was possible to reduce the "steepness of the current quenching capacity" to less than 20% of the value of pure CrCu50 contact pieces and that consequently, with the occurrence of multiple re-ignitions in the load circuit, virtual current ruptures no longer occurred. At the same time, it was possible to reach short-circuit current break powers of 20 to 25 kA at 12 kV nominal voltage. This means an increase by more than 50% as compared with conventional overvoltage-reducing contact pieces made of such materials which have a homogeneous, unlayered construction.

Although preferred embodiments of the present invention have been described in detail, it will be understood that modifications may be made by those skilled in the art all within the spirit and scope of the present invention as defined in the claims.

What is claimed is:

1. In a contact piece for vacuum switchgear having as switching surface wherein said contact piece comprises a base material body with an additive of a readily vaporizable element so as to produce a sufficiently conductive switching path upon circuit breaking, said additive being present at least in the region of said contact piece near the switching surface, the improvement comprising:

said additive is concentrated as intermetallic phases having a softening or melting point greater than the needed vacuum brazing temperature said additive being concentrated only in a layer firmly adhered to and covering said switching surface of said base material body of said contact piece wherein said base material is a CuCr material having a volume percentage of from about 30% to about 60% Cr, and said additive comprises at least as one component said readily vaporizable element having a vapor pressure of more than about 1 mbr at 1000° C.

2. A contact piece according to claim 1 wherein said readily vaporizable element is a member selected from the group consisting of selenium (Se), tellurium (Te), lead (Pb), bismuth (Bi), barium (Ba), calcuim (Ca), cerium (Ce), indium (In), lanthanum (La), lithium (Li), antimony (Sb), and strontium (Sr) and mixtures thereof which form intermetallic phases with one another or with an additional metal.

3. A contact piece according to claim 2 wherein said additional metal is a member selected from the group consisting of silver (Ag), aluminum (Al), copper (Cu), magnesium (Mg), samarium (Sm), tin (Sn), titanium (Ti), zinc (Zn), and zirconium (Zr) and mixtures thereof.

4. A contact piece according to claim 3 wherein said additive has a softening or melting point above about 800° C.

5. A contact piece according to claim 2 wherein said additive is an intermetallic compound selected from the group consisting of $Ag_2Se$, $Ag_2Te$, $Al_2Se_3$, $Al_2Te_3$, $Ba_2Bi_3$, $Ba_2Pb$, $Bi_2Ca_3$, $Bi_3Ce_4$, $Bi_3La_4$, $BiLi_3$, $Bi_2Mg_3$, $Bi_2Zr_3$, $Ca_2Pb$, $Cu_2Se$, $Cu_2Te$, $In_2Se_3$, LaPb, $La_2Pb$, $Li_2Se$, $Li_2Te$, PbSe, $Pb_3Sm$, PbTe, $PbTi_2$, $Pb_3Zr_5$, SeSn, SeZn, TeTi, and TeZn and mixtures thereof.

6. A contact piece according to claim 1 wherein said adhering layer has a thickness of less than about 2 mm.

7. A contact piece according to claim 6 wherein said adhering layer has a thickness of less than about 1 mm.

8. A contact piece according to claim 1 wherein said adhering layer has a thickness of greater than about 1/100 mm.

9. A method of manufacturing a contact piece according to claim 1 comprising placing said additive on the switching surface of said base material body of said contact piece and fusing said additive onto said surface.

10. A method according to claim 9 wherein said additive placed on said surface is in powder form.

11. A method according to claim 9 wherein said additive placed on said surface is in granulate form.

12. A method according to claim 9 wherein said additive placed on said surface is in the form of a foil.

13. A method according to claim 7 wherein said additive placed on said surface is in the form of a sheet.

14. A method according to claim 9 wherein said additive contains proportions of said base material.

15. A method according to claim 9 wherein said additive placed on said surface is in the form of a pressed powder and a portion of said pressed powder comprises said base material.

16. A method according to claim 15 wherein about ⅓ of the total volume of said pressed powder is composed of said base material.

17. A method of manufacturing a contact piece according to claim 1 comprising placing said additive in a pressed powder form on the switching surface of the base material body of said contact piece with a portion of said pressed powder comprised of said base material and bonding said pressed powder to said surface by liquid phase sintering.

18. A method according to claim 17 wherein about ⅓ of the total volume of said pressed powder is composed of said base material.

19. A method of manufacturing a contact piece according to claim 1 comprising vapor depositing said additive onto the switching surface of said base material body of said contact piece.

20. A method according to claim 19 wherein said vapor deposition is performed by sputtering.

21. A method according to claim 19 wherein said vapor deposition is performed by ion plating.

22. A method according to claim 9 wherein the base material is CuCr and comprising first providing said additive in the form of intermetallic phases having a melting point lower than about 800° C., thermally dissociating said intermetallic phases and reacting said dissociated phases with Cu thereby forming soldering resisting alloys or second intermetallic phases.

23. A method according to claim 22 wherein said intermetallic phases are selected from the group consisting of InSe, InTe, $In_2Te_3$, $Sb_2Se_3$, $Sb_2Te_3$ and SnTe and mixtures thereof.

24. A method according to claim 9 wherein the base material is CuCr comprising first providing said additive in the form of intermetallic phases having a melting point lower than about 800° C., thermally dissociating said intermetallic phases and reacting said dissociated phases with Cu thereby forming soldering resisting alloys or second intermetallic phases.

25. A method according to claim 22 wherein said formed soldering resisting alloys or second intermetallic phases have a melting point greater than about 800° C.

26. A method according to claim 24 wherein said formed soldering resisting alloys or second intermetallic phases have a melting point greater than about 800° C.

* * * * *